US011501936B2

(12) United States Patent
Takeda

(10) Patent No.: US 11,501,936 B2
(45) Date of Patent: Nov. 15, 2022

(54) TEMPERATURE SWITCH

(71) Applicant: Uchiya Thermostat Co., Ltd., Saitama (JP)

(72) Inventor: Hideaki Takeda, Misato (JP)

(73) Assignee: Uchiya Thermostat Co., Ltd., Saitama (JP)

( * ) Notice: Subject to any disclaimer, the term of this patent is extended or adjusted under 35 U.S.C. 154(b) by 0 days.

(21) Appl. No.: 17/309,527

(22) PCT Filed: Jul. 19, 2019

(86) PCT No.: PCT/JP2019/028513
§ 371 (c)(1),
(2) Date: Jun. 4, 2021

(87) PCT Pub. No.: WO2020/121584
PCT Pub. Date: Jun. 18, 2020

(65) Prior Publication Data

US 2022/0028637 A1 Jan. 27, 2022

(30) Foreign Application Priority Data

Dec. 12, 2018 (JP) ..... JP2018-232065

(51) Int. Cl.
*H01H 37/54* (2006.01)
*H01H 3/60* (2006.01)

(52) U.S. Cl.
CPC ..... *H01H 37/5427* (2013.01); *H01H 3/60* (2013.01); *H01H 2037/5481* (2013.01); *H01H 2205/002* (2013.01)

(58) Field of Classification Search
CPC ..... H01H 37/5427; H01H 3/60; H01H 2037/5481; H01H 2205/002; H01H 37/54
See application file for complete search history.

(56) References Cited

U.S. PATENT DOCUMENTS 3,196,233 A * 7/1965 Parkhurst ..... H01H 37/54 200/409
6,396,381 B1 * 5/2002 Takeda ..... H01H 1/504 337/377

(Continued)

FOREIGN PATENT DOCUMENTS

JP 2004501488 A * 1/2004 ..... H01H 37/54
JP 3099032 U 3/2004

(Continued)

OTHER PUBLICATIONS

Cornell; Christopher, "Creepless Snap Acting Bimetallic Switch Having Step Adjacent Its Bimetallic Element", Nov. 29, 2001, Elmwood Sensors, Entire Document (WO0191152—Translation of JP 2004501488). (Year: 2001).*

(Continued)

*Primary Examiner* — Stephen S Sul
(74) *Attorney, Agent, or Firm* — Schwegman Lundberg & Woessner, P.A.

(57) ABSTRACT

A temperature switch includes an elastically deformable movable plate, a movable contact on the movable plate, a fixed contact facing the movable contact, a thermally deformable member, a vibration suppression section, and a cover. The thermally deformable member is elastically deformed in accordance with a temperature change to elastically deform the movable plate such that the movable contact is in contact with the fixed contact or spaced apart from the fixed contact. The vibration suppression section suppresses vibrations of the movable plate by contacting a fixed-edge side when the movable plate is elastically deformed to shift the movable plate from being in contact with the fixed contact to being spaced apart therefrom. The cover surrounds the movable and fixed contacts, and the vibration suppression section is a projecting section provided on the cover.

5 Claims, 11 Drawing Sheets

(56) References Cited

U.S. PATENT DOCUMENTS

| | | | | |
|---|---|---|---|---|
| 2003/0058079 | A1* | 3/2003 | Sullivan | H01H 37/5418 337/365 |
| 2003/0122650 | A1* | 7/2003 | Yamamoto | H01H 37/5427 337/333 |
| 2005/0057336 | A1* | 3/2005 | Toyosaki | H01H 1/60 337/85 |
| 2014/0300445 | A1* | 10/2014 | Takeda | H01H 71/16 337/362 |
| 2017/0062161 | A1 | 3/2017 | Takeda | |
| 2017/0294281 | A1* | 10/2017 | Takeda | H01H 37/64 |

FOREIGN PATENT DOCUMENTS

| | | | |
|---|---|---|---|
| JP | 2005327623 | A | 11/2005 |
| JP | 2018190514 | A | 11/2018 |
| WO | WO-2015129093 | A1 | 9/2015 |

OTHER PUBLICATIONS

"International Application Serial No. PCT/JP2019/028513 , International Search Report dated Oct. 1, 2019", w/ English Translation, (Oct. 1, 2019), 3 pgs.

"International Application Serial No. PCT/JP2019/028513, Written Opinion dated Oct. 1, 2019", w/ English Translation, (Oct. 1, 2019), 7 pgs.

* cited by examiner

TEMPERATURE SWITCH

PRIORITY APPLICATIONS

This application is a U.S. National Stage Filing under 35 U.S.C. § 371 from International Application No. PCT/JP2019/028513, filed on Jul. 19, 2019, and published as WO2020/121584 on Jun. 18, 2020, which claims the benefit of priority to Japanese Application No. 2018-232065, filed on Dec. 12, 2018; the benefit of priority of each of which is hereby claimed herein, and which applications and publication are hereby incorporated herein by reference in their entirety.

TECHNICAL FIELD

The present invention relates to a temperature switch that controls a current by means of elastic deformation caused by a change in the temperature of a thermally deformable member.

BACKGROUND ART

In a conventional temperature switch that drives a movable plate provided with contacts by means of a bimetal, the movable plate is an elastic body, in particular a spring, so strong vibrations remain on the leading edge portion of the movable plate after a movable contact is separated from a fixed contact. The vibrations could cause an arc. The arc can be a problem especially when a direct current flows.

In a proposed temperature switch, accordingly, a movable flat section is formed by bending the leading edge portion of a movable plate, and the movable flat section absorbs vibrations after separation of a movable contact from a fixed contact (see, for example, patent document 1).

PRIOR ART DOCUMENT

Patent Document

Patent Document 1: International Publication Pamphlet No. WO 2015/129093

SUMMARY OF THE INVENTION

Problems to be Solved by the Invention

In a temperature switch provided with a movable plate including a movable flat section as described above, however, the movable flat section is provided by bending the leading edge portion of the movable plate, so the original shape of the movable plate is significantly changed. Thus, manufacturing facilities need to be changed, and the temperature switch needs to be reevaluated.

An object of the present invention is to provide a temperature switch that can suppress vibrations of a movable plate provided with a movable contact by means of a simple configuration.

Means for Solving Problems

In one aspect, a temperature switch includes: a movable plate that is elastically deformable; a movable contact provided on the movable plate; a fixed contact provided so as to face the movable contact; a thermally deformable member that is elastically deformed in accordance with a temperature change so as to elastically deform the movable plate such that the movable plate is positioned at a contact position such that the movable contact is in contact with the fixed contact or a spaced position such that the movable contact is spaced apart from the fixed contact; and a vibration suppression section that suppresses vibrations of the movable plate by contacting a portion of the movable plate on a fixed-edge side of the movable plate with reference to a center of the movable contact when the movable plate is elastically deformed to shift from the contact position to the spaced position.

Effect of the Invention

The aspect allows vibrations of a movable plate provided with a movable contact to be suppressed by means of a simple configuration.

DESCRIPTION OF EMBODIMENTS

Figure 1:
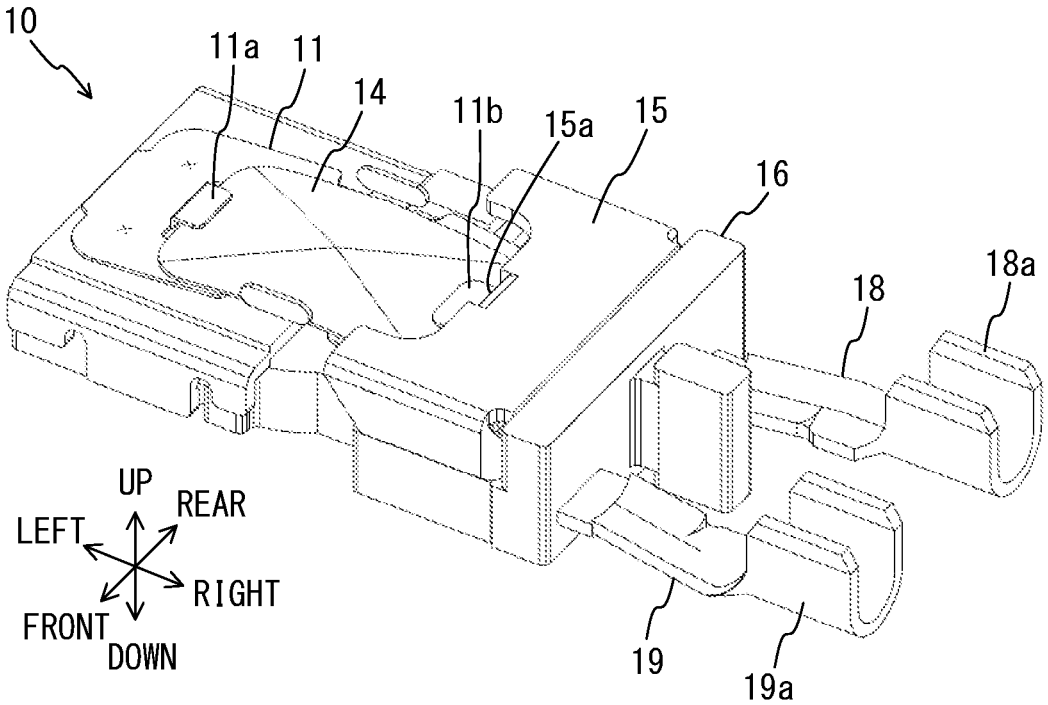
FIG. 1 is a perspective view illustrating a temperature switch in accordance with a first embodiment.

By referring to the drawings, the following describes a temperature switch (suppression of vibrations of a movable plate) in accordance with first to fifth embodiments of the present invention.

First Embodiment

Figure 2:
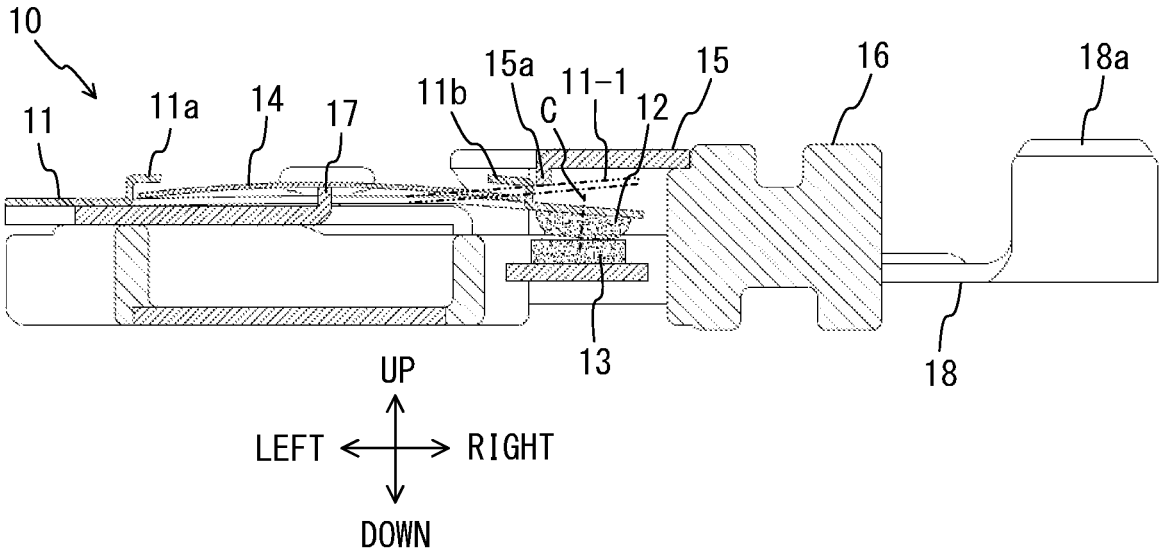
FIG. 2 is a cross-sectional view illustrating a temperature switch in accordance with a first embodiment.

FIGS. 1 and 2 are a perspective view and a cross-sectional view illustrating a temperature switch 10 in accordance with a first embodiment.

The up-down direction, the front-rear direction, and the left-right direction indicated in FIGS. 1 and 2 and FIGS. 3-11 (described hereinafter) are merely examples for descriptive purposes. For example, the up-down direction may be a vertical direction, and the front-rear direction and the left-right direction may be horizontal directions.

The temperature switch 10 depicted in FIGS. 1 and 2 includes a movable plate 11, a movable contact 12, a fixed contact 13, a bimetal element 14, a protective cover 15, a base 16, a supporting section 17, a first terminal 18, and a second terminal 19.

The movable plate 11 is an elastically deformable plate formed from, for example, stainless or a copper alloy. The movable plate 11 is connected to the first terminal 18. The movable plate 11 includes a pair of supporting lug sections 11*a* and 11*b* for supporting the bimetal element 14. The supporting lug sections 11*a* and 11*b* protrude upward from the movable plate 11 and are bent in a lateral direction (left-right direction) above the bimetal element 14.

As indicated in FIG. 2, the movable contact 12 is provided on a portion of the bottom surface of the movable plate 11 that is in the vicinity of a free edge portion (right edge portion) and connected to the first terminal 18 via the movable plate 11.

The fixed contact 13 is provided so as to face the movable contact 12 and connected to the second terminal 19.

The bimetal element 14 is an example of a thermally deformable member (thermally actuated element) that is elastically deformed in accordance with a temperature change so as to elastically deform the movable plate 11 such that the movable plate 11 is positioned at a contact position such that the movable contact 12 is in contact with the fixed contact 13 (see FIG. 2) or a spaced position such that the movable contact 11 is spaced apart from the fixed contact 13 (see the movable plate 11-1 indicated by a two-dot dash line in FIG. 2). For example, the bimetal element 14 may be formed by laminating two alloys shaped like flat plates having different thermal expansion coefficients, and may be inverted (elastically deformed) with a setting temperature as a threshold. When the bimetal element 14 is inverted such that the center thereof projects upward, the bimetal element 14 inverts the movable plate 11 such that the movable plate 11 is positioned at the contact position. When the bimetal element 14 is inverted such that the center thereof projects downward, the bimetal element 14 inverts the movable plate 11 such that the movable plate 11 is positioned at the spaced position.

The protective cover 15 depicted in FIGS. 1 and 2 is an example of a cover disposed to surround the movable contact 12 and the fixed contact 13. For example, the protective cover 15 may be a metallic cover. As depicted in FIG. 2, the protective cover 15 is provided with a projecting section 15*a* protruding downward. The projecting section 15*a* is an example of a vibration suppression section that suppresses vibrations of the movable plate 11 by contacting a portion of the movable plate 11 on a fixed-edge side (left side) of the movable plate 11 with reference to a center C of the movable contact 12 when the movable plate 11 is inverted to shift from the contact position to the spaced position. Alternatively, the projecting section 15*a* may be provided on the movable plate 11. In this case, a portion of the protective cover 15 that contacts the projecting section of the movable plate 11 will function as a vibration suppression section. The projecting section of the movable plate 11 may be the supporting lug section 11*b*.

The protective cover 15 is arranged such that after the movable plate 11 has come into contact with the projecting section 15*a* of the protective cover 15, the portion of the protective cover 15 that is located on the free-edge side (right side) of the movable plate 11 with reference to the center C (see FIG. 2) of the movable contact 12 is not in contact with the movable plate 11.

The base 16 is formed from an insulation material.

The supporting section 17 supports the center of the bottom surface of the bimetal element 14 in such a manner as to penetrate the movable plate 11 from below.

Crimping sections 18*a* and 19*a* are provided on the leading end portions of the first terminal 18 and the second terminal 19. The crimping sections 18*a* and 19*a* are crimped with external lead wires (not illustrated) held therein.

In the first embodiment, the temperature switch 10 includes: the movable plate 11 that is elastically deformable; the movable contact 12 provided on the movable plate 11; the fixed contact 13 provided so as to face the movable contact 12; the bimetal element 14, i.e., an example of the thermally deformable member, which is elastically deformed in accordance with a temperature change so as to elastically deform the movable plate 11 such that the movable plate 11 is positioned at the contact position such that the movable contact 12 is in contact with the fixed contact 13 (see FIG. 2) or the spaced position such that the movable contact 12 is spaced apart from the fixed contact 13 (see the movable plate 11-1 indicated by a two-dot dash line in FIG. 2); and the projecting section 15*a*, i.e., an example of the vibration suppression section, which suppresses vibrations of the movable plate 11 by contacting a portion of the movable plate 11 on the fixed-edge side (left side) of the movable plate 11 with reference to the center C of the movable contact 12 when the movable plate 11 is elastically deformed to shift from the contact position to the spaced position.

Accordingly, the free-edge side of the movable plate 11 vibrates with the projecting section 15*a* as a fulcrum. The vibration frequency decreases in inverse proportion to the square of the length, and the vibrations with the projecting section 15*a* as the fulcrum and the vibrations of the entirety of the movable plate 11 extending from the fixed-edge side to the free edge portion cancel each other out, so that the vibrations of the movable plate 11 can be suppressed. As a result, a long contact distance can be maintained between the movable contact 12 and the fixed contact 13 directly after the movable contact 12 is spaced apart from the fixed contact 13. Owing to the simple configuration in which the vibration suppression section (projecting section 15*a*) is provided, accordingly, vibrations of the movable plate 11 that occur when the movable plate 11 is elastically deformed (inverted) to shift from the contact position to the spaced position can be suppressed. Thus, the interruption performance between the movable contact 12 and the fixed contact 13 for a direct current can be greatly improved. The service life of the movable contact 12 and the fixed contact 13 is largely affected by an arc that occurs between the contacts. As long as a contact gap can be formed concurrently with current interruption, implementing a stable state with a large distance means quick arc cutting, so that durability can be improved even in the case of alternating current interruption.

In the first embodiment, the temperature switch 10 further includes the protective cover 15, i.e., an example of the cover, which is disposed to surround the movable contact 12 and the fixed contact 13, and the vibration suppression section is the projecting section 15*a* provided on the protective cover 15. Owing to the simple configuration in which the projecting section 15*a* is provided on the protective cover 15, accordingly, vibrations of the movable plate 11 can be suppressed.

In the first embodiment, the protective cover 15, i.e., an example of the cover, is arranged such that after the movable plate 11 has come into contact with the projecting section 15*a*, i.e., an example of the vibration suppression section, the portion of the protective cover 15 that is located on the free-edge side (right side) of the movable plate 11 with reference to the center C (see FIG. 2) of the movable contact 12 is not in contact with the movable plate 11. Accordingly, in comparison to when the protective cover 15 contacts the portion of the movable plate 11 that is located on the free-edge side with reference to the center C of the movable contact 12, the movable contact 12 can be prevented from contacting the fixed contact 13 again due to rebounding after the movable plate 11 is elastically deformed to shift from the contact position to the spaced position.

Second Embodiment

Figure 3:
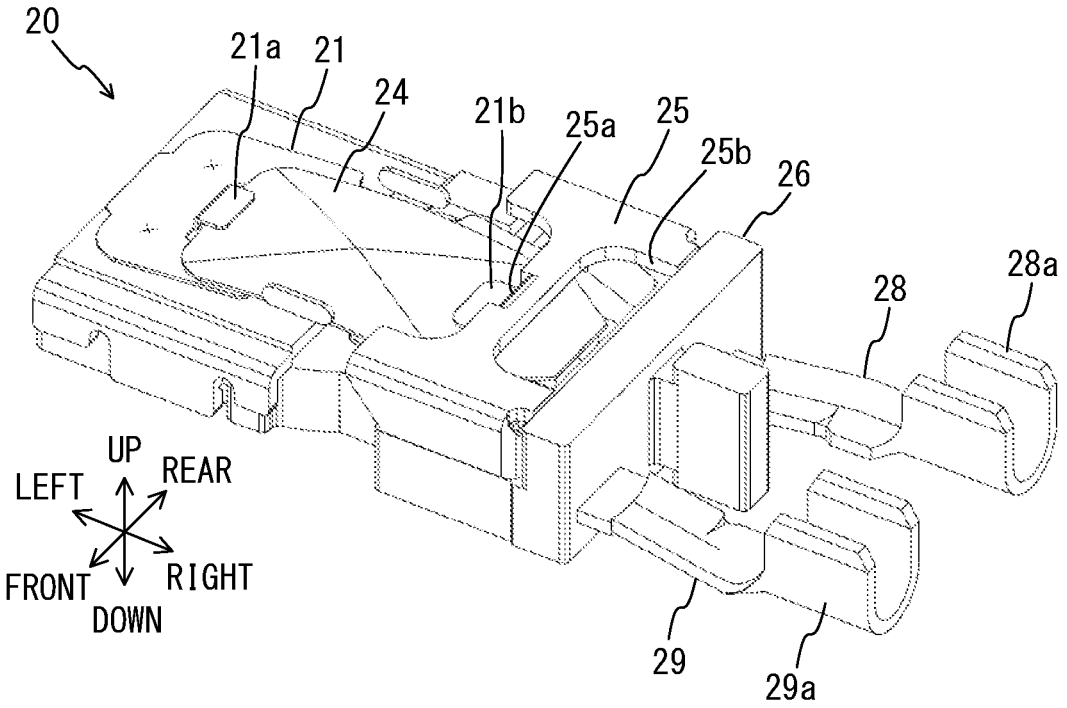
FIG. 3 is a perspective view illustrating a temperature switch in accordance with a second embodiment.

FIG. 3 is a perspective view illustrating a temperature switch 20 in accordance with a second embodiment.

The second embodiment is different from the first embodiment only in that a protective cover 25, i.e., an example of the cover, includes a notch 25*b*. Otherwise, the second embodiment may be similar to the first embodiment.

Accordingly, as with the temperature switch 10 in accordance with the first embodiment, the temperature switch 20 includes a movable plate 21 including supporting lug sections 21*a* and 21*b*, a movable contact 22, a fixed contact 23, a bimetal element 24, a protective cover 25 including a projecting section 25*a*, a base 26, a supporting section 27, a first terminal 28 including a crimping section 28*a*, and a second terminal 29 including a crimping section 29*a*. As described above, the protective cover 25 further includes the notch 25*b*.

The notch 25*b* is provided to prevent the free-edge side (right side) of the movable plate 21 and the protective cover 25 from coming into contact with each other. In particular, the protective cover 25 is arranged such that after the movable plate 21 has come into contact with the projecting section 25*a* of the protective cover 25, the portion of the protective cover 25 that is located on the free-edge side of the movable plate 21 with reference to the center C (see FIG. 2) of the movable contact 22 is not in contact with the movable plate 21.

The protective cover 25 does not necessarily need to include the notch 25*b*. For example, the free-edge side (right side) of the movable plate 21 and the protective cover 25 can be prevented from coming contact with each other by means of a configuration in which a recessed section dented upward is provided in the bottom surface of the protective cover 25 or a configuration in which a through hole is provided through the protective cover 25. In addition, as in the first embodiment, the free-edge side of the movable plate 21 and the protective cover 25 can be prevented from coming contact with each other without providing the notch 25*b* in the protective cover 25.

The second embodiment can exhibit similar effects to the first embodiment in terms of similar matters, e.g., the effect of suppressing vibrations of the movable plate 21 by means of the simple configuration.

In the second embodiment, the protective cover 25, i.e., an example of the cover, includes the notch 25*b* so as to be arranged such that after the movable plate 21 has come into contact with the projecting section 25*a*, i.e., an example of the vibration suppression section, the portion of the protective cover 25 that is located on the free-edge side (right side) of the movable plate 21 with reference to the center C (see FIG. 2) of the movable contact 22 is not in contact with the movable plate 21. Accordingly, even when the protective cover 25 is positioned close to the movable plate 21 so as to miniaturize the temperature switch 20, the movable contact 22 can be more reliably prevented from contacting the fixed contact 23 again due to rebounding after the movable plate 21 is elastically deformed to shift from the contact position to the spaced position.

Third Embodiment

Figure 4:
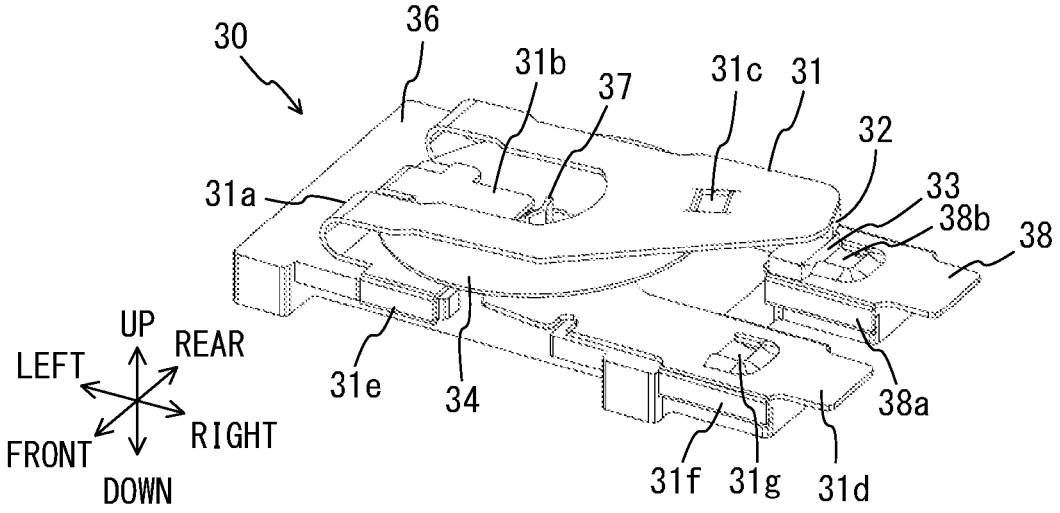
FIG. 4 is a perspective view illustrating a temperature switch in accordance with a third embodiment.

FIG. 4 is a perspective view illustrating a temperature switch 30 in accordance with a third embodiment.

Figure 5:
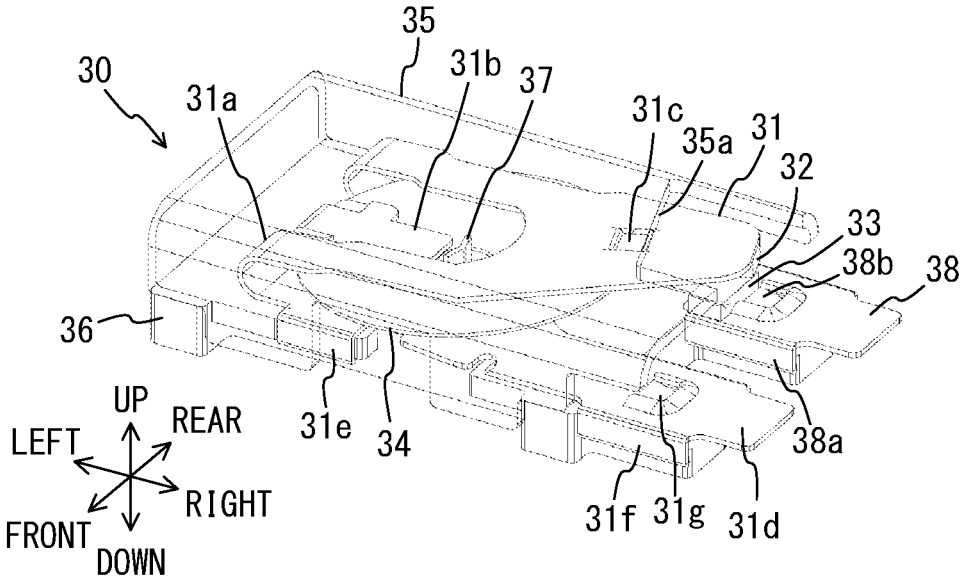
FIG. 5 is a perspective view transparently illustrating the internal structure of a temperature switch mounted with an insulation case in accordance with a third embodiment.
Figure 6:
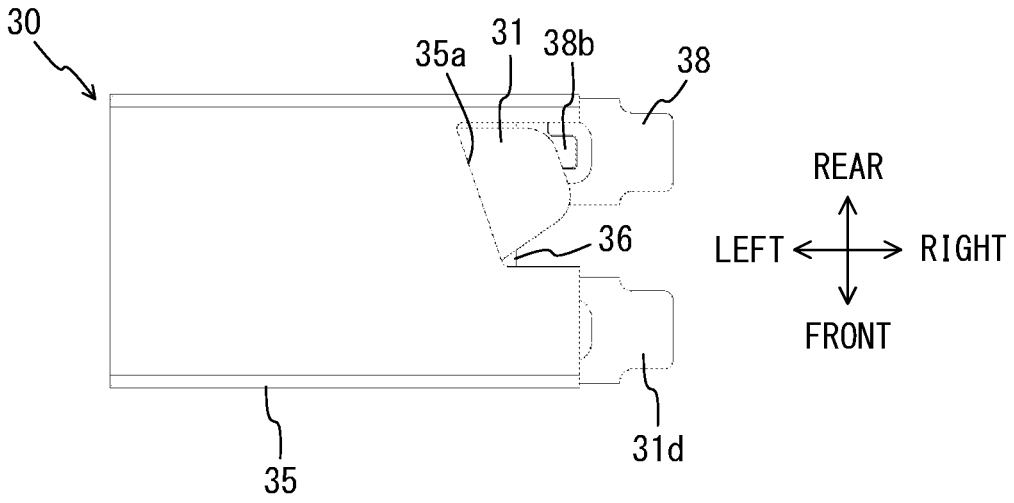
FIG. 6 is a plan view illustrating a temperature switch mounted with an insulation case in accordance with a third embodiment.
Figure 7:
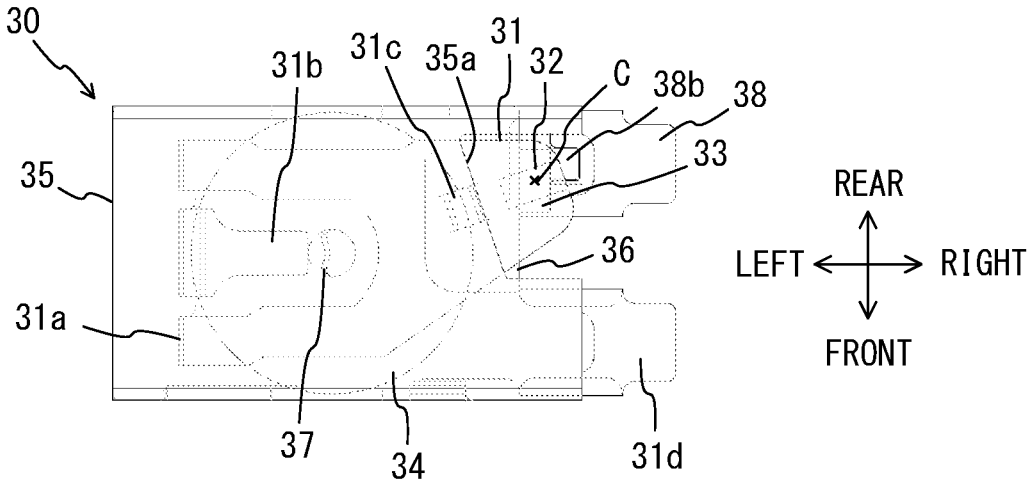
FIG. 7 is a plan view transparently illustrating the internal structure of a temperature switch mounted with an insulation case in accordance with a third embodiment.

FIGS. 5-7 each illustrate a temperature switch 30 mounted with an insulation case 35. FIG. 5 is a perspective view transparently illustrating the internal structure. FIG. 6 is a plan view. FIG. 7 is a plan view transparently illustrating the internal structure.

As depicted in FIGS. 4-7, the temperature switch 30 includes a movable plate 31, a movable contact 32, a fixed contact 33, a bimetal element 34, an insulation case 35 (see FIGS. 5-7), a base 36, a supporting section 37, and a second terminal 38.

The movable plate 31 includes a bent section 31*a*, a supporting extending section 31*b*, a supporting recessed section 31*c*, a first terminal 31*d*, holding sections 31*e* and 31*f*, and a stopper 31*g*. The movable plate 31 is an elastically deformable plate formed from, for example, stainless or a copper alloy.

The bent section 31*a* is a portion of the movable plate 31 that has been bent in a U shape. The portion of the movable plate 31 that is located on a free-edge side (upper side) with reference to the bent section 31*a* is three-pronged. The supporting extending section 31*b*, which is the center of the three prongs, supports the bimetal element 34. The outer two of the three prongs become integral with each other by being joined again on the free-edge side and extend in a curved manner toward the second terminal 38 (rearward) with the width in the front-rear direction decreasing. The integral portion includes the supporting recessed section 31*c*, which is dented downward. As with the supporting extending section 31*b*, the supporting recessed section 31*c* supports the bimetal element 34.

The first terminal 31*d* is provided on the movable plate 31 so as to be positioned on an opposite side of the bent section 31*a* from the movable contact 32 (provided on the lower side than the movable contact 32), and is connected to an external lead wire (not illustrated). The first terminal 31*d* extends forward of the second terminal 38 from the bent-section-31*a* side. The width of the first terminal 31*d* in the front-rear direction is less than that of the bent section 31*a*.

The holding sections 31*e* are provided at both edge portions of the movable plate 31 in the width direction (front-rear direction) so as to be disposed at positions close to the bent section 31*a* on the portion of the movable plate 31 that is located on the first-terminal-31*d* side with reference to the bent section 31*a* (the portion located on the lower side than the bent section 31*a*). The holding sections 31*e* may be bent downward and then bent toward the lower portion of the base 36 so as to sandwich the base 36.

The holding sections 31*f* are provided at both edge portions of the movable plate 31 in the width direction (front-rear direction) so as to be disposed at positions close to the first terminal 31*d* on the portion of the movable plate 31 that is located on the first-terminal-31*d* side with reference to the bent section 31*a* (the portion located on the lower side than the bent section 31*a*). The holding sections 31*f* may be bent downward and then bent toward the lower portion of the base 36 so as to sandwich the base 36.

The holding sections 31*e* and 31*f* hold the base 36 by being sliding-inserted leftward on the base 36 while sandwiching the base 36.

The stopper 31*g* is provided on the movable plate 31 so as to be positioned on the first-terminal-31*d* side with reference to the bent section 31*a* (the lower side than the bent section 31*a*). The stopper 31*g* is a stopper for locking the movable plate 31 on the base 36. For example, the stopper 31*g* may be a lug extending downward from the movable plate 31 and caught on the upper surface of the base 36 with the movable plate 31 sliding-inserted on the base 36.

As depicted in FIGS. 4 and 5, the movable contact 32 is provided on the bottom surface of the portion of the movable plate 31 that is located on the opposite side of the bent section 31*a* from the first terminal 31*d* (the upper side than the first terminal 31*d*).

The fixed contact 33 is provided on the second terminal 38 so as to face the movable contact 32.

The bimetal element 34 is an example of a thermally deformable member that is elastically deformed in accordance with a temperature change so as to elastically deform the movable plate 31 such that the movable plate 31 is positioned at a contact position such that the movable contact 32 is in contact with the fixed contact 33 or a spaced position such that the movable contact 32 is spaced apart from the fixed contact 33. In the third embodiment, the bimetal element 34 assumes, as depicted in FIG. 7, a disk shape (shaped like a doughnut surrounding the supporting section 37). When the bimetal element 34 is inverted such that the center thereof projects downward, the circumference of the bimetal element 34 is supported by the supporting extending section 31*b* and the supporting recessed section 31*c*. In this case, the bimetal element 34 elastically deforms the movable plate 31 such that the movable plate 31 is positioned at the spaced position such that the movable contact 32 is spaced apart from the fixed contact 33.

When the bimetal element 34 is inverted such that the center thereof projects upward, the movable plate 31 is elastically deformed so as to bring the movable contact 32 into contact with the fixed contact 33. In this case, the movable plate 31 is not pressed upward by the bimetal element 34 and returns to the contact position such that the movable contact 32 is in contact with the fixed contact 33.

The insulation case 35 depicted in FIGS. 5-7 is an example of a cover disposed to surround the movable contact 32 and the fixed contact 33 and is positioned on an upper portion of the temperature switch 30 so as to cover the movable plate 31 and the bimetal element 34.

The insulation case 35 includes a notch 35*a*, i.e., an example of an opening. The opening may be a through hole provided through the insulation case 35.

An edge of the notch 35*a* is an example of a vibration suppression section that suppresses vibrations of the movable plate 31 by contacting a portion of the movable plate 31 on a fixed-edge side (left side) of the movable plate 31 with reference to a center C (see FIG. 7) of the movable contact 32 when the movable plate 31 is inverted to shift from the contact position to the spaced position. The notch 35*a* may be provided to prevent the free-edge side (right side) of the movable plate 31 and the insulation case 35 from coming into contact with each other.

The insulation case 35 and the base 36 are formed from an insulation material. The material for the insulation case 35 may be a metal.

The supporting section 37 supports the bimetal element 34 in such a manner as to penetrate the bimetal element 34 from below.

The second terminal 38 is provided with the fixed contact 33. The second terminal 38 includes holding sections 38*a* and a stopper 38*b*. The holding sections 38*a* are provided on both edge portions of the second terminal 38 in the width direction (front-rear direction). The holding sections 38*a* may be bent downward and then bent toward the lower portion of the base 36 so as to sandwich the base 36.

As with the holding sections 31*e* and 31*f*, the holding sections 38*a* hold the base 36 by being sliding-inserted leftward on the base 36 while sandwiching the base 36.

The stopper 38*b* is provided in the vicinity of the fixed contact 33 and serves to lock the second terminal 38 on the base 36. For example, the stopper 38*b* may be a lug extending downward from the second terminal 38 and caught on the upper surface of the base 36 with the second terminal 38 sliding-inserted on the base 36.

In the third embodiment, as in the first and second embodiments, the temperature switch 30 includes: the movable plate 31 that is elastically deformable; the movable contact 32 provided on the movable plate 31; the fixed contact 33 provided so as to face the movable contact 32; the bimetal element 34, i.e., an example of the thermally deformable member, which is elastically deformed in accordance with a temperature change so as to elastically deform the movable plate 31 such that the movable plate 31 is positioned at a contact position such that the movable contact 32 is in contact with the fixed contact 33 or a spaced position such that the movable contact 32 is spaced apart from the fixed contact 33; and the edge of the notch 35*a*, i.e., an example of the vibration suppression section, which suppresses vibrations of the movable plate 31 by contacting a portion of the movable plate 31 on the fixed-edge side (left side) of the movable plate 31 with reference to the center C (see FIG. 7) of the movable contact 32 when the movable plate 31 is elastically deformed to shift from the contact position to the spaced position.

Owing to the simple configuration in which the vibration suppression section (the edge of the notch 35*a* of the insulation case 35) is provided, accordingly, vibrations of the movable plate 31 that occur when the movable plate 31 is elastically deformed to shift from the contact position to the spaced position can be suppressed, as in the first and second embodiments.

In the third embodiment, the insulation case 35, i.e., an example of the cover, which is disposed to surround the movable contact 32 and the fixed contact 33, is further provided, and the vibration suppression section is the edge of the notch 35*a*, i.e., an example of the opening, which is provided in the insulation case 35. Owing to the simple configuration in which the insulation case 35 includes the notch 35*a*, accordingly, vibrations of the movable plate 31 can be suppressed.

In the third embodiment, the insulation case 35, i.e., an example of the cover, includes the notch 35*a* such that after the movable plate 31 has come into contact with the edge of the notch 35*a*, the portion of the insulation case 35 that is located on the free-edge side (right side) of the movable plate 31 with reference to the center C (see FIG. 7) of the movable contact 32 is not in contact with the movable plate 31. Accordingly, even when the insulation case 35 is positioned close to the movable plate 31 so as to miniaturize the temperature switch 30, the movable contact 32 can be more reliably prevented from contacting the fixed contact 33 again due to rebounding after the movable plate 31 is elastically deformed to shift from the contact position to the spaced position.

In the third embodiment, an example of the cover disposed to surround the movable contact 32 and the fixed contact 33 is the insulation case 35 disposed to cover the movable plate 31 and the bimetal element 34. Thus, the existing insulation case 35 can be the member that includes the notch 35*a*, so vibrations of the movable plate 31 can be suppressed by means of the simple configuration.

In the third embodiment, the movable plate 31 includes: the bent section 31*a* bent in a U shape; the first terminal 31*d*, i.e., an example of the terminal connected to an external lead wire; the holding sections 31*e* and 31*f* that are provided on the first-terminal-31*d* side with reference to the bent section 31*a* (lower side than the bent section 31*a*) and hold the base 36 by being sliding-inserted on the base 36; and the stopper 31*g* that is provided on the first-terminal-31*d* side with reference to the bent section 31*a* and serves to lock the movable plate 31 on the base 36, wherein the movable contact 32 is provided on the opposite side of the bent section 31*a* of the movable plate 31 from the first terminal 31*d* (the upper side than the first terminal 31*d*). Thus, vibrations of the movable plate 31 can be absorbed not only by the edge of the notch 35*a* and the movable plate 31 coming into contact with each other but also absorbed by the bent section 31*a*, so that vibrations of the movable plate 31 can be suppressed more effectively. In addition, vibrations that occur when the edge of the notch 35*a* and the movable plate 31 contact each other can be reduced.

Fourth Embodiment

Figure 8:
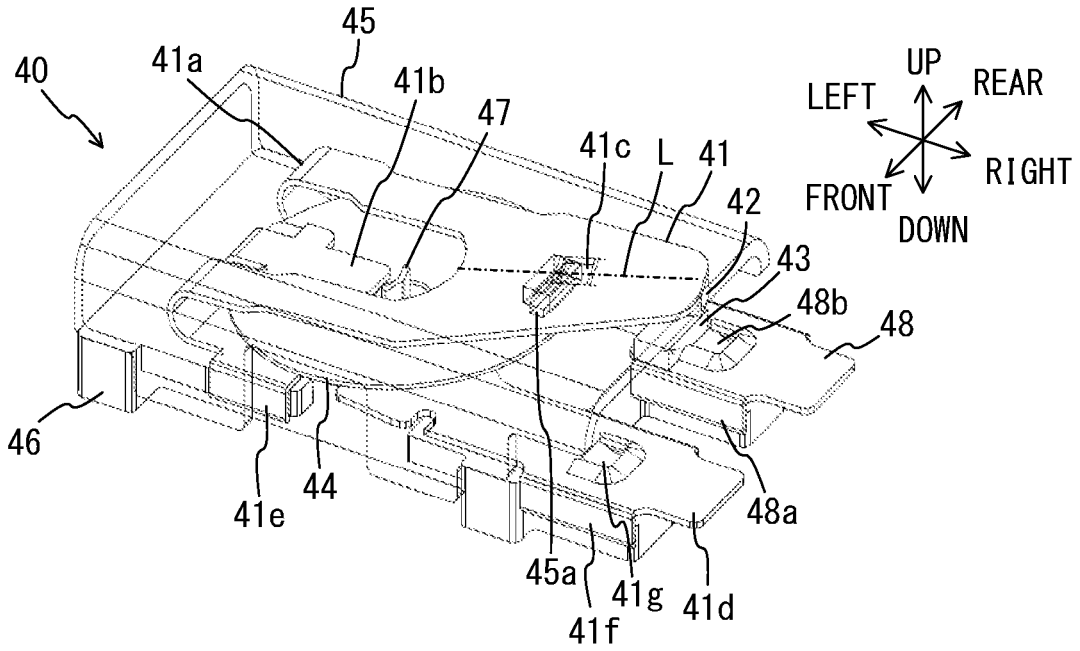
FIG. 8 is a perspective view transparently illustrating the internal structure of a temperature switch mounted with an insulation case in accordance with a fourth embodiment.
Figure 9:
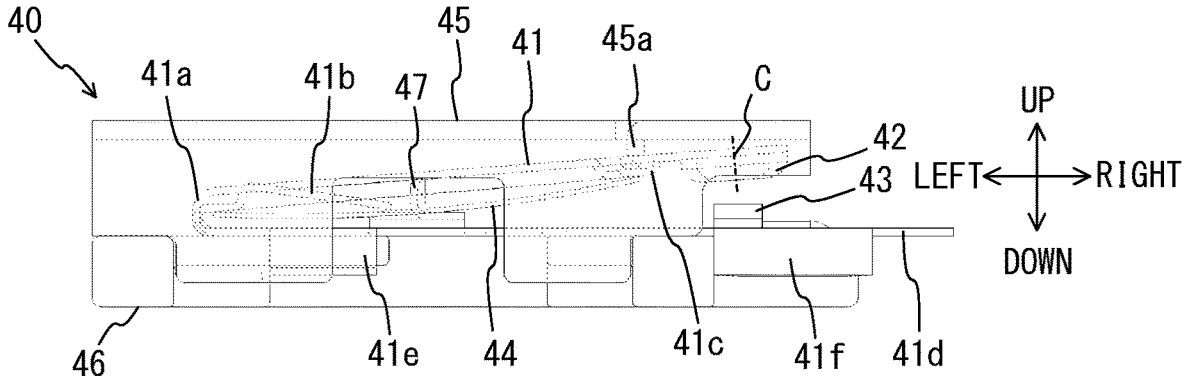
FIG. 9 is a front view transparently illustrating the internal structure of a temperature switch mounted with an insulation case in accordance with a fourth embodiment.

FIGS. 8 and 9 are a perspective view and a front view transparently illustrating the internal structure of a temperature switch 40 mounted with an insulation case 45.

The fourth embodiment is different from the third embodiment only in that: the insulation case 45 includes a projecting section 45*a*, not the notch 35*a*; the projection section 45*a* comes into contact with a movable plate 41; and the projecting section 45*a* is in contact with the movable plate 41 at a position shifted (offset) in the width direction (front-rear direction) with reference to a center line L linking a fixed edge portion and a free edge portion of the movable plate 41. Otherwise, the fourth embodiment may be similar to the third embodiment.

Accordingly, as with the temperature switch 30 in accordance with the third embodiment, the temperature switch 40 includes: the movable plate 41, which is provided with a bent section 41*a*, a supporting extending section 41*b*, a supporting recessed section 41*c*, a first terminal 41*d*, holding sections 41*e* and 41*f*, and a stopper 41*g*; a movable contact 42; a fixed contact 43; a bimetal element 44; an insulation case 45; a base 46; a supporting section 47; and a second terminal 48 provided with holding sections 48*a* and a stopper 48*b*. As indicated above, the insulation case 45 is provided with the projecting section 45*a*.

As depicted in FIG. 9, the projecting section 45*a* of the insulation case 45 protrudes downward. The projecting section 45*a* is an example of a vibration suppression section that suppresses vibrations of the movable plate 41 by contacting a portion of the movable plate 41 on a fixed-edge side (left side) of the movable plate 41 with reference to a center C of the movable contact 42 when the movable plate 41 is elastically deformed to shift from a contact position to a spaced position. Alternatively, the projecting section 45*a* may be provided on the movable plate 41. In this case, a portion of the insulation case 45 that contacts the projecting section of the movable plate 41 will function as a vibration suppression section.

While the projecting section 45*a* is provided at the center of the insulation case 45 in the width direction (front-rear direction), the projecting section 45*a* is in contact with the movable plate 41 at a position shifted in the width direction with reference to the center line L of the movable plate 41 because the free-edge side (right side) of the movable plate 41 extends in a curved manner toward the second terminal 48 (rearward). The aspect in which the vibration suppression section (projecting section 45*a*) is, as described above, in contact with the movable plate 41 at a position shifted in the width direction with reference to the center line L of the movable plate 41 (fourth embodiment) may be applied to the first and second embodiments as well as a fifth embodiment (described hereinafter). Note that the fourth embodiment corresponds to the third embodiment with the noted aspect applied thereto.

In the fourth embodiment, the insulation case 45 is also arranged such that after the movable plate 41 has come into contact with the projecting section 45*a* of the insulation case 45, the portion of the insulation case 45 that is located on the free-edge side (right side) of the movable plate 41 with reference to the center C (see FIG. 9) of the movable contact 42 is not in contact with the movable plate 41.

The fourth embodiment can exhibit similar effects to the third embodiment in terms of similar matters, e.g., the effect of suppressing vibrations of the movable plate 41 by means of the simple configuration.

In the fourth embodiment, the vibration suppression section is the projecting section 45*a* provided on the insulation case 45, i.e., an example of the cover, which is disposed to surround the movable contact 42 and the fixed contact 43. Owing to the simple configuration in which the insulation case 45 includes the protruding section 45*a*, accordingly, vibrations of the movable plate 41 can be suppressed.

In the fourth embodiment, the projecting section 45*a*, i.e., an example of the vibration suppression section, is in contact with the movable plate 41 at a position shifted in the width direction (front-rear direction) with reference to the center line L linking the fixed edge portion and the free edge portion of the movable plate 41. Thus, vibrations of the movable plate 41 that occur when the movable plate 41 is elastically deformed to shift from the contact position to the spaced position can be the vibrations of the small portion of the movable plate 41 that is located on the free-edge side (right side) with reference to the portion of contact between the projecting section 45*a* and the movable plate 41, and the vibrations of the movable plate 41 can be canceled out by the movable plate 41 being elastically deformed in a torsional direction. Hence, vibrations of the movable plate 41 can be suppressed more effectively.

Fifth Embodiment

Figure 10:
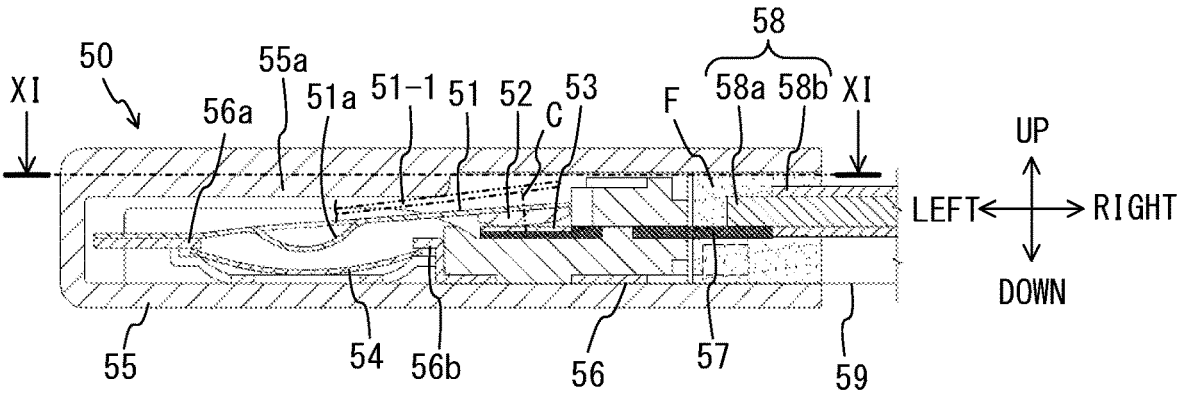
FIG. 10 is a cross-sectional view illustrating a temperature switch mounted with an insulation case in accordance with a fifth embodiment.

FIG. 10 is a cross-sectional view illustrating a temperature switch 50 mounted with an insulation case 55 in accordance with a fifth embodiment.

Figure 11:
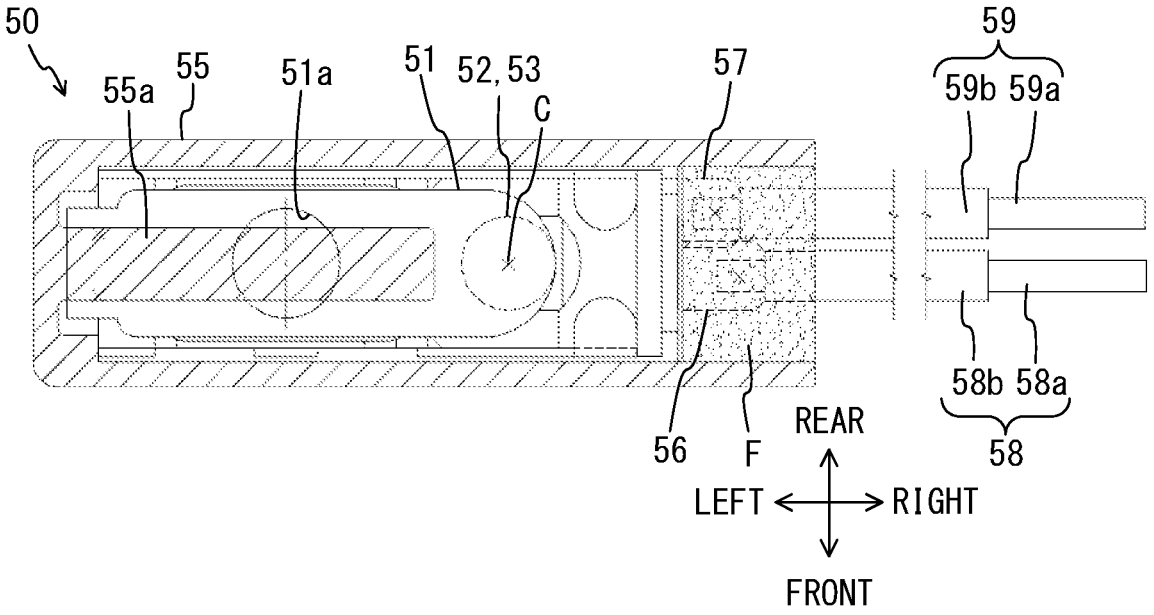
FIG. 11 is a XI-XI cross-sectional view of FIG. 10.

FIG. 11 is a XI-XI cross-sectional view of FIG. 10.

The temperature switch 50 depicted in FIGS. 10 and 11 includes a movable plate 51, a movable contact 52, a fixed contact 53, a bimetal element 54, an insulation case 55, a first terminal 56, and a second terminal 57.

The movable plate 51 is an elastically deformable plate formed from, for example, stainless or a copper alloy. The movable plate 51 is connected to the first terminal 56. The movable plate 51 includes a recessed section 51*a* that can be in contact with the bimetal element 54.

The movable contact 52 is provided on a portion of the movable plate 51 that is in the vicinity of a free edge portion and connected to the first terminal 56 via the movable plate 51.

The fixed contact 53 is provided on the second terminal 57 so as to face the movable contact 52.

The bimetal element 54 is an example of a thermally deformable member that is elastically deformed in accordance with a temperature change so as to elastically deform the movable plate 51 such that the movable plate 51 is positioned at a contact position such that the movable contact 52 is in contact with the fixed contact 53 (see FIG.

10) or a spaced position such that the movable contact 52 is spaced apart from the fixed contact 53 (see the movable plate 51-1 indicated by a two-dot dash line in FIG. 10). For example, when the bimetal element 54 is inverted such that the center thereof projects upward, the bimetal element 54 may elastically deform the movable plate 51 such that the movable plate 51 is positioned at the spaced position.

The insulation case 55 is an example of a cover disposed to surround the movable contact 52 and the fixed contact 53 and covers the movable plate 51 and the bimetal element 54. The insulation case 55 is shaped like a cuboid, and an opening is formed only in a surface of the insulation case 55 located on the side where the first terminal 56 and the second terminal 57 are provided (right side). The insulation case 55 is formed from an insulation material.

The insulation case 55 has an upper bottom surface from which a projecting section 55*a* protrudes downward. The projecting section 55*a* is an example of a vibration suppression section that suppresses vibrations of the movable plate 51 by contacting a portion of the movable plate 51 on the fixed-edge side (left side) of the movable plate 51 with reference to the center C of the movable contact 52 when the movable plate 51 is elastically deformed to shift from the contact position to the spaced position. Alternatively, the projecting section 55*a* may be provided on the movable plate 51. In this case, a portion of the insulation case 55 that contacts the projecting section of the movable plate 51 will function as a vibration suppression section.

In the fifth embodiment, the insulation case 55 is also arranged such that after the movable plate 51 has come into contact with the projecting section 55*a* of the insulation case 55, the portion of the insulation case 55 that is located on the free-edge side (right side) of the movable plate 51 with reference to the center C of the movable contact 52 is not in contact with the movable plate 51.

The first terminal 56 includes supporting lug sections 56*a* and 56*b*. The supporting lug sections 56*a* and 56*b* are provided so as to protrude upward of the bimetal element 54. As depicted in FIG. 11, a first lead wire 58 is connected to the first terminal 56. The first lead wire 58 includes a core wire 58*a* and an insulating sheath 58*b* covering the core wire 58*a*.

A second lead wire 59 is connected to the second terminal 57. The second lead wire 59 includes a core wire 59*a* and an insulating sheath 59*b* covering the core wire 59*a*.

The opening in the insulation case 55 is filled with a filling material F constituted by an insulating synthetic resin. The filling material F covers the connection between the first terminal 56 and the first lead wire 58 and the connection between the second terminal 57 and the second lead wire 59.

In the fifth embodiment, as in the first to fourth embodiments, the temperature switch 50 includes: the movable plate 51 that is elastically deformable; the movable contact 52 provided on the movable plate 51; the fixed contact 53 provided so as to face the movable contact 52; the bimetal element 54, i.e., an example of the thermally deformable member, which is elastically deformed in accordance with a temperature change so as to elastically deform the movable plate 51 such that the movable plate 51 is positioned at a contact position such that the movable contact 52 is in contact with the fixed contact 53 (see FIG. 10) or a spaced position such that the movable contact 52 is spaced apart from the fixed contact 53 (see the movable plate 51-5 indicated by a two-dot dash line in FIG. 10); and the projecting section 55*a*, i.e., an example of the vibration suppression section, which suppresses vibrations of the movable plate 51 by contacting a portion of the movable plate 51 on the fixed-edge side (left side) of the movable plate 51 with reference to the center C of the movable contact 52 when the movable plate 51 is elastically deformed to shift from the contact position to the spaced position.

Owing to the simple configuration in which the vibration suppression section (the projecting section 55*a* of the insulation case 55) is provided, accordingly, vibrations of the movable plate 51 that occur when the movable plate 51 is elastically deformed to shift from the contact position to the spaced position can be suppressed, as in the first to fourth embodiments.

In the fifth embodiment, the temperature switch 50 further includes the insulation case 55, i.e., an example of the cover, which is disposed to surround the movable contact 52 and the fixed contact 53, and the vibration suppression section is the projecting section 55*a* provided on the insulation case 55. Owing to the simple configuration in which the insulation case 55 includes the protruding section 55*a*, accordingly, vibrations of the movable plate 51 can be suppressed.

In the fifth embodiment, the insulation case 55, i.e., an example of the cover, is arranged such that after the movable plate 51 has come into contact with the projecting section 55*a*, i.e., an example of the vibration suppression section, the portion of the insulation case 55 that is located on the free-edge side (right side) of the movable plate 51 with reference to the center C of the movable contact 52 is not in contact with the movable plate 51. Accordingly, in comparison to when the insulation case 55 contacts the portion of the movable plate 51 that is located on the free-edge side with reference to the center C of the movable contact 52, the movable contact 52 can be prevented from contacting the fixed contact 53 again due to rebounding after the movable plate 51 is elastically deformed to shift from the contact position to the spaced position.

In the fifth embodiment, an example of the cover disposed to surround the movable contact 52 and the fixed contact 53 is the insulation case 55 disposed to cover the movable plate 51 and the bimetal element 54. Thus, the existing insulation case 55 can be the member that includes the projecting section 35*a*, so vibrations of the movable plate 51 can be suppressed by means of the simple configuration.

The first to fifth embodiments have been described herein, but the present invention falls within the scope of the invention set forth in the claims and within the equivalent thereof. The following indicates, as appendixes, the invention recited in the claims of the present application as originally filed.

Appendix 1. A temperature switch comprising:

a movable plate that is elastically deformable;

a movable contact provided on the movable plate;

a fixed contact provided so as to face the movable contact;

a thermally deformable member that is elastically deformed in accordance with a temperature change so as to elastically deform the movable plate such that the movable plate is positioned at a contact position such that the movable contact is in contact with the fixed contact or a spaced position such that the movable contact is spaced apart from the fixed contact; and a vibration suppression section that suppresses vibrations of the movable plate by contacting a portion of the movable plate on a fixed-edge side of the movable plate with reference to a center of the movable contact when the movable plate is elastically deformed to shift from the contact position to the spaced position.

Appendix 2. The temperature switch of appendix 1, further comprising:

a cover disposed to surround the movable contact and the fixed contact, wherein the vibration suppression section is a projecting section provided on the cover.

Appendix 3. The temperature switch of appendix 1, further comprising:

a cover disposed to surround the movable contact and the fixed contact, wherein the vibration suppression section is an edge of an opening provided in the cover.

Appendix 4. The temperature switch of appendix 2 or 3, wherein the cover is arranged such that after the movable plate has come into contact with the vibration suppression section, a portion of the cover that is located on a free-edge side of the movable plate with reference to the center of the movable contact is not in contact with the movable plate.

Appendix 5. The temperature switch of any of appendixes 2-4, wherein the cover is an insulation case disposed to cover the movable plate and the thermally deformable member.

Appendix 6. The temperature switch of any of appendixes 1-5, wherein the vibration suppression section is in contact with the movable plate at a position shifted in a width direction with reference to a center line linking a fixed edge portion and a free edge portion of the movable plate.

Appendix 7. The temperature switch of any of appendixes 1-6, wherein the movable plate includes a bent section bent in a U shape, a terminal connected to an external lead wire, a holding section provided on a terminal side with reference to the bent section and holding a base by being sliding-inserted on the base, and a stopper that is provided on the terminal side with reference to the bent section and serves to lock the movable plate on the base, and the movable contact is provided on an opposite side of the bent section of the movable plate from the terminal.

EXPLANATION OF THE CODES

10: Temperature switch
11: Movable plate
11*a*, 11*b*: Supporting lug section
12: Movable contact
13: Fixed contact
14: Bimetal element
15: Protective cover
15*a*: Projecting section
16: Base
17: Supporting section
18: First terminal
18*a*: Crimping section
19: Second terminal
19*a*: Crimping section
20: Temperature switch
21: Movable plate
21*a*, 21*b*: Supporting lug section
22: Movable contact
23: Fixed contact
24: Bimetal element
25: Protective cover
25*a*: Projecting section
25*b*: Notch
26: Base
27: Supporting section
28: First terminal
28*a*: Crimping section
29: Second terminal
29*a*: Crimping section
30: Temperature switch
31: Movable plate
31*a*: Bent section
31*b*: Supporting extending section
31*c*: Supporting recessed section
31*d*: First terminal
31*e*, 31*f*: Holding section
31*g*: Stopper
32: Movable contact
33: Fixed contact
34: Bimetal element
35: Insulation case
35*a*: Notch
36: Base
37: Supporting section
38: Second terminal
38*a*: Holding section
38*b*: Stopper
40: Temperature switch
41: Movable plate
41*a*: Bent section
41*b*: Supporting extending section
41*c*: Supporting recessed section
41*d*: First terminal
41*e*, 41*f*: Holding section
41*g*: Stopper
42: Movable contact
43: Fixed contact
44: Bimetal element
45: Insulation case
45*a*: Projecting section
46: Base
47: Supporting section
48: Second terminal
48*a*: Holding section
48*b*: Stopper
50: Temperature switch
51: Movable plate
51*a*: Recessed section
52: Movable contact
53: Fixed contact
54: Bimetal element
55: Insulation case
55*a*: Projecting section
56: First terminal
56*a*, 56*b*: Supporting lug section
57: Second terminal
58: First lead wire
58*a*: Core wire
58*b*: Sheath
59: Second lead wire
59*a*: Core wire
59*b*: Sheath
C: Center of movable contact
F: Filling material
L: Center line

The invention claimed is:

1. A temperature switch comprising:

a movable plate that is elastically deformable;

a movable contact provided on the movable plate;

a fixed contact provided so as to face the movable contact;

a thermally deformable member that is elastically deformed in accordance with a temperature change so as to elastically deform the movable plate such that the movable plate is positioned at a contact position such that the movable contact is in contact with the fixed contact or a spaced position such that the movable contact is spaced apart from the fixed contact; and a vibration suppression section that suppresses vibrations of the movable plate by contacting a portion of the movable plate on a fixed-edge side of the movable plate with reference to a center of the movable contact when the movable plate is elastically deformed to shift from the contact position to the spaced position; and a cover disposed to surround the movable contact and the fixed contact, wherein the vibration suppression section is an edge of an opening provided in the cover.

2. The temperature switch of claim 1, wherein the cover is arranged such that after the movable plate has come into contact with the vibration suppression section, a portion of the cover that is located on a free-edge side of the movable plate with reference to the center of the movable contact is not in contact with the movable plate.

3. The temperature switch of claim 1, wherein the cover is an insulation case disposed to cover the movable plate and the thermally deformable member.

4. A temperature switch comprising:

a movable plate that is elastically deformable;

a movable contact provided on the movable plate;

a fixed contact provided so as to face the movable contact;

a thermally deformable member that is elastically deformed in accordance with a temperature change so as to elastically deform the movable plate such that the movable plate is positioned at a contact position such that the movable contact is in contact with the fixed contact or a spaced position such that the movable contact is spaced apart from the fixed contact, and a vibration suppression section that suppresses vibrations of the movable plate by contacting a portion of the movable plate on a fixed-edge side of the movable plate with reference to a center of the movable contact when the movable plate is elastically deformed to shift from the contact position to the spaced position, wherein the vibration suppression section is in contact with the movable plate at a position shifted in a width direction with reference to a center line linking a fixed edge portion and a free edge portion of the movable plate.

5. A temperature switch comprising:

a movable plate that is elastically deformable;

a movable contact provided on the movable plate;

a fixed contact provided so as to face the movable contact;

a thermally deformable member that is elastically deformed in accordance with a temperature change so as to elastically deform the movable plate such that the movable plate is positioned at a contact position such that the movable contact is in contact with the fixed contact or a spaced position such that the movable contact is spaced apart from the fixed contact; and a vibration suppression section that suppresses vibrations of the movable plate by contacting a portion of the movable plate on a fixed-edge side of the movable plate with reference to a center of the movable contact when the movable plate is elastically deformed to shift from the contact position to the spaced position, wherein:

the movable plate includes a bent section bent in a U shape, a first terminal provided on the movable plate, a holding section provided on a first terminal side with reference to the bent section and holding a base by being sliding-inserted on the base, and a stopper that is provided on the first terminal side with reference to the bent section and serves to lock the movable plate on the base, and the movable contact is provided on an opposite side of the bent section of the movable plate from the first terminal.

* * * * *